US006158480A

United States Patent [19]

Pedrini

[11] Patent Number: 6,158,480

[45] Date of Patent: Dec. 12, 2000

[54] YARN RESERVE MONITORING DEVICE IN WEFT FEEDERS FOR WEAVING LOOMS

[75] Inventor: Giovanni Pedrini, Leffe, Italy

[73] Assignee: L.G.L. Electronics S.p.A., Gandino, Italy

[21] Appl. No.: 09/329,180

[22] Filed: Jun. 10, 1999

[30] Foreign Application Priority Data

Jun. 16, 1998 [IT] Italy ..... TO98A0520

[51] Int. Cl.[7] ..... B65H 51/22; D03D 47/34

[52] U.S. Cl. ..... 139/452; 242/364.8; 66/132 R

[58] Field of Search ..... 66/132 R; 139/452; 242/364.8, 365.3

[56] References Cited

U.S. PATENT DOCUMENTS

| | | | |
|---|---|---|---|
| 3,844,504 | 10/1974 | Lawson . | |
| 4,325,540 | 4/1982 | Hintsch . | |
| 5,590,547 | 1/1997 | Conzelmann | 139/452 |
| 5,613,528 | 3/1997 | Zenoni et al. | 139/452 |

FOREIGN PATENT DOCUMENTS

| | | |
|---|---|---|
| 2 239 882 | 2/1975 | France . |
| 2 439 249 | 5/1980 | France . |
| 196 11 998 | 10/1997 | Germany . |
| 196 22 254 | 12/1997 | Germany . |

*Primary Examiner*—Andy Falik

*Attorney, Agent, or Firm*—Guido Modiano; Daniel O'Byrne; Albert Josif

[57] ABSTRACT

A device for monitoring the yarn reserve in weft feeders for textile looms, comprising an active element which is capable of detecting the presence of the turns of yarn that constitute the yarn reserve wound on the drum of the feeder. The device is associated with an intermediate support of its own which is pivoted to the fixed frame of the feeder and can oscillate about its own pivoting fulcrum in contrast with the action of a contrast spring in order to vary the contact pressure or inclination of the active element on, or with respect to, the drum of the feeder; the oscillation for adjusting the intermediate support of the monitoring device is produced by a downward-acting adjustment screw which acts on said support.

6 Claims, 4 Drawing Sheets

YARN RESERVE MONITORING DEVICE IN WEFT FEEDERS FOR WEAVING LOOMS

BACKGROUND OF THE INVENTION

The present invention relates to a yarn reserve monitoring device in weft feeders for weaving looms.

It is known that weft feeders are devices adapted to be interposed between the spool of yarn and the loom and comprise a fixed drum on which a windmilling arm winds a plurality of turns of yarn which constitute a weft: reserve.

When requested by the loom, at each beat, the turns unwind from the drum in order to feed said loom and a monitoring element is provided in order to activate the windmilling arm when the reserve drops below a lower limit and to stop the arm when the reserve reaches the upper limit.

Typically, the monitoring element is constituted by a mechanical feeler with an oscillating arm which rests with a slight pressure on the lateral surface of the fixed drum of the feeder and which, in the presence of the turns of the reserve, performs an angular motion about its own pivot in order to affect an optical sensor and screen it so as to produce a stop signal for the windmilling arm.

According to other known solutions, the presence of the turns of the reserve on the drum of the feeder is detected directly by one or more optical detectors capable of providing corresponding signals for stopping or starting the windmilling arm.

In the case of the mechanical feeler, the need sometimes arises to adjust the pressure with which the feeler arm rests on the lateral surface of the drum of the weft feeder, for example in order to adapt the sensitivity of the feeler to the various kinds of yarn being processed.

In the case of mechanical feelers as well as in the case of optical detectors, the need may otherwise arise to vary the angle of the feeler or, respectively, of the detector with respect to the generatrices of the drum in order to vary the position of the first turn of the weft reserve so as to correspondingly vary the number of turns that compose the reserve accumulated on the drum.

In such cases, conventional devices require troublesome interventions which, besides requiring considerable downtimes of the weft feeder—and therefore of the weaving process—require the intervention of highly specialized operators, on whose skill and experience the effectiveness of the adjustment depends to a large extent.

This is an evident and severe drawback of conventional feeler devices which the present invention essentially has the aim of eliminating.

SUMMARY OF THE INVENTION

The aim of the present invention is to provide monitoring device which allows to perform quickly, easily and with considerable precision the above-mentioned adjustments both in terms of contact pressure of a mechanical feeler arm on the drum of the feeder and in terms of angle of the arm or, as an alternative, of the support of an optical detector with respect to the generatrices of the drum.

According to the present invention, this aim, this object and others which will become apparent from the detailed description that follows are achieved with a feeler device having the specific characteristics stated in the appended claims.

Substantially, the improvement according to the present invention consists in associating the monitoring device with an intermediate support of its own which is pivoted to the fixed frame of the feeder and can oscillate about its own pivoting fulcrum in contrast with the action of a contrast spring in order to vary the contact pressure or inclination of the active element on, or with respect to, the drum of the feeder; the oscillation for adjusting the intermediate support of the monitoring device being produced by a downward-acting screw which presses on said support and correspondingly applies a load to said contrast spring.

BRIEF DESCRIPTION OF THE DRAWINGS

Further characteristics and advantages of the monitoring device according to the present invention will become apparent from the following detailed description and with reference to the accompanying drawings, given by way of non-limitative example and wherein:

FIGS. 2 and 3 are enlarged-scale sectional views of details of FIG. 1, illustrating respective extreme positions of the adjustment of the monitoring device of FIG. 1 while

DESCRIPTION OF THE PREFERRED EMBODIMENTS

Figure 1:
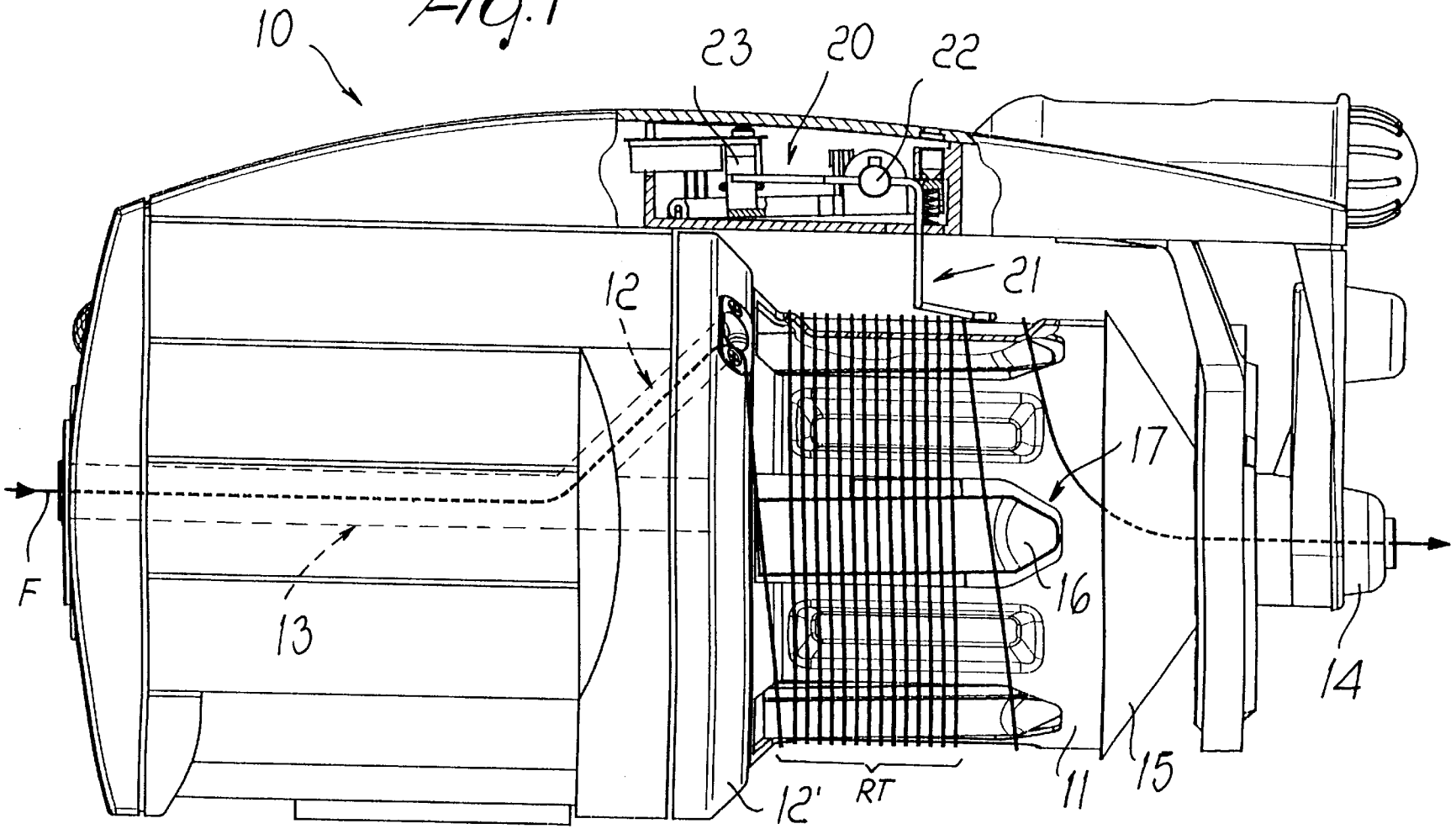
FIG. 1 is a partially sectional elevation view of a weft feeder with the monitoring device according to the invention.

In the drawings, the reference numeral 10 generally designates a conventional weft feeder comprising a fixed drum 11 on which a windmilling hollow arm 12, driven by a driving shaft 13 which is also hollow and associated with a disk 12' located at the base of the drum, winds a plurality of turns of yarn F which constitute a weft reserve RT. When requested by the textile loom (not shown), at each beat the yarn unwinds from the drum and reaches a yarn guide 14, passing through a braking means 15 which adjusts the tension of the yarn, keeping it substantially constant. A conventional system of movable rods 16 which protrude in a cyclic manner from slots 17 formed in the lateral surface of the drum 11 moves the turns of yarn from the base toward the front end section of the drum, and a monitoring device, generally designated by the reference numeral 20, is provided to start and stop the windmilling arm 12 in order to automatically replenish and maintain the weft reserve RT.

In the illustrated example, the monitoring device 20 is of the mechanical type and comprises a feeler arm 21 (active element) which is oscillatably supported by a pivot 22 and has a portion 21*a,* provided with an L-shaped end part arranged in contact with the yarn section of the reserve RT, and a portion 21*b,* which is adapted to cooperate with an optical sensor 23. With this known arrangement, the feeler arm 21, in the presence of reserve turns, oscillates through an angle about its own pivot 22 and screens, with its portion 21*b,* the optical sensor 23, generating a stop signal for the arm 12.

According to the present invention, the entire assembly of the monitoring device 20, constituted by the feeler arm 21 (active element) with the corresponding pivot 22, and of the optical sensor 23 is associated with an intermediate support 24 of its own which is pivoted at "f" to the fixed frame 10' of the feeder 10 and can oscillate about the axis of its own pivoting fulcrum "f" in contrast with the action of a contrast spring 25. A downward-acting adjustment screw 26 is provided in order to vary the inclination of the intermediate support 24 with respect to the frame 10' in order to adjust the contact pressure of the feeler arm 21 on the cylindrical lateral surface of the drum 11 and/or the inclination of said arm with respect to the generatrices of said lateral surface. The adjustment screw 26, advantageously of the hexagonal socket head type, can be accessed by means of a through hole 27 of the housing of the feeder 10 and presses on the support 24, lowering it and correspondingly loading the spring 25.

Owing to the inclined and subhorizontal configuration of the L-shaped end of the portion 21*a* of the feeler arm 21, the variation in the inclination of the support 24 produced by the adjustment screw 26 produces a corresponding variation in the position of the first turn of the reserve RT and accordingly a variation in the total number of turns that form the reserve.

Figure 2:
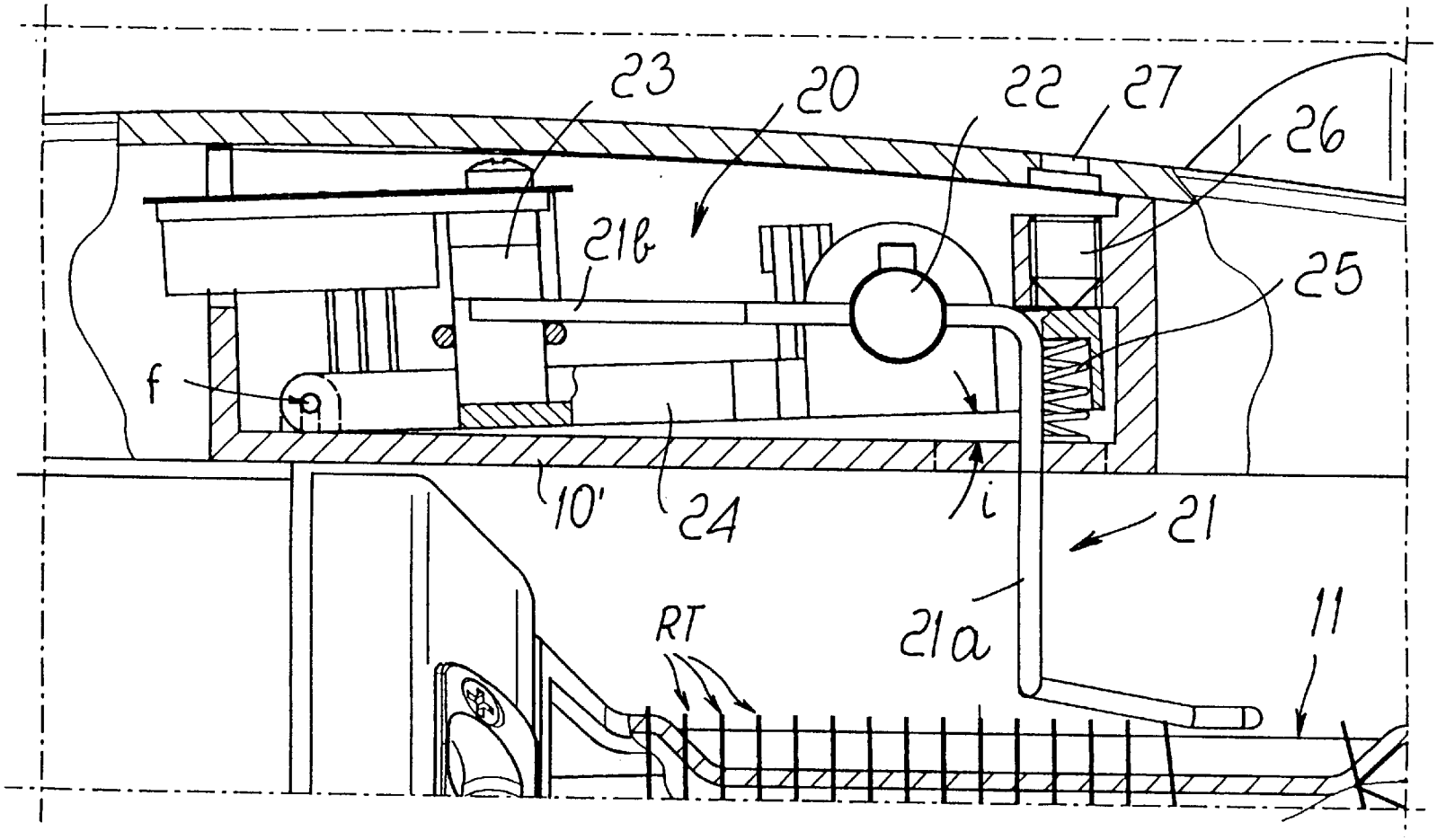
Figure 2A:
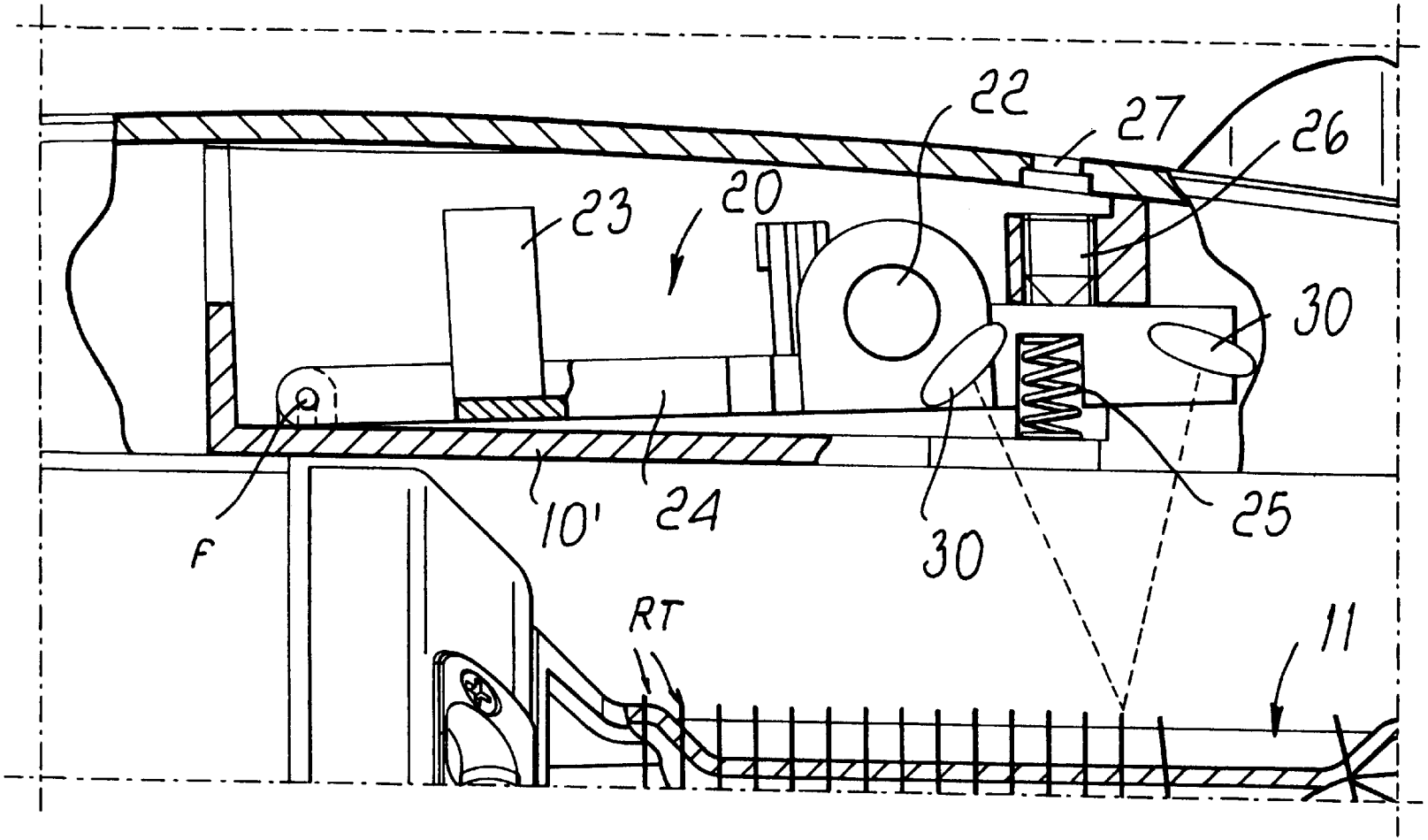
FIG. 2*a* is an enlarged scale sectional view of details of FIG. 1 illustrating a second embodiment of the monitoring device according to the present invention.
Figure 3:
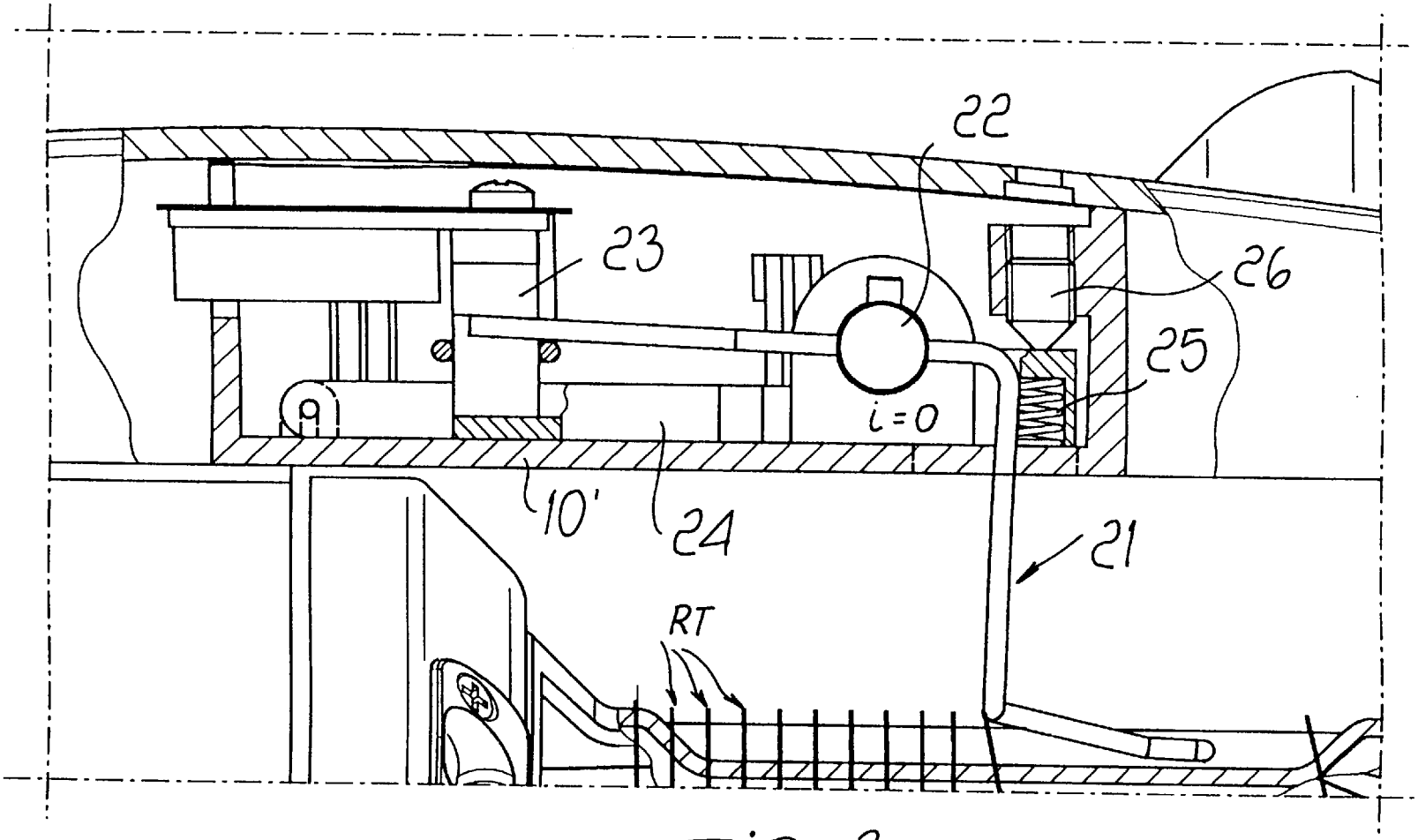

FIGS. 2 and 3 illustrate the two angular adjustment positions, respectively for maximum and minimum inclination "i" of the support 24, which are matched, for example, by a variation which increases or respectively decreases by four turns the weft reserve RT; the number of added or subtracted turns changes correspondingly in the intermediate adjustment position.

According to the invention, the variation of the inclination of the support 24 is also used, when required, to vary the contact pressure of the feeler arm 21 on the lateral surface of the drum 21, or more precisely on the turns of yarn wound on the drum, so as to correspondingly vary the sensitivity of the device 20 in order to adapt it, for example, to the count of the different yarns being processed.

Although the invention has been described with reference to a monitoring device 20 provided with a mechanical feeler, such embodiment is nonrestrictive, since the same intermediate support 24 with adjustable inclination can be used in combination with an optical sensor 30 associated therewith and capable of directly detecting the presence of the turns of the reserve and of varying the position of the first turn when the angle of incidence between the sensor and the lateral surface of the drum 11 varies due to the variation in the inclination of said intermediate support. In this case the active element is constituted just by the sensor 30 since the feleer 21 recited in the first embodiment of the invention is substituted by the optical sensor 30.

Moreover, without altering the concept of the invention, the details of execution and the embodiments may of course be altered extensively with respect to what has been described and illustrated by way of non-limitative example without thereby abandoning the scope of the invention.

What is claimed is:

1. A device for monitoring yarn reserve in weft feeders for textile looms, comprising an active element which is capable of detecting the presence of turns of yarn that constitute a yarn reserve wound on a drum of the feeder, wherein said device includes an intermediate support adapted to be pivoted to a fixed frame of the feeder for oscillation about its pivoting fulcrum via a contrast spring, the device further including a downwardly-acting adjusting screw acting on the support for varying the contact pressure or inclination of the active element on, or with respect to, the drum of the feeder.

2. The device according to claim 1, wherein said active element is a mechanical element and further comprises a feeler arm which is supported so that it can oscillate by a pivot and has a portion with an L-shaped end arranged in contact with the turns of yarn of the reserve and a portion which is adapted to cooperate with an optical sensor which, in the presence of the turns of the reserve, emits a stop signal for a further arm which winds said turns on the drum of the feeder.

3. The device according to claim 2, wherein the L-shaped end of the feeler arm has a subhorizontal configuration for varying, by the manipulation of said adjustment screw, the number of turns of the yarn reserve as the inclination of said intermediate support varies.

4. The device according to claim 2, wherein the manipulation of the adjusting screw against an end of said support causes the contact pressure of said L-shaped end of the feeler arm on the lateral surface of the drum of the feeder to vary as the inclination of said intermediate support varies.

5. The device according to claim 1, wherein said active element is constituted by an optical sensor which is connected to said intermediate support for directly detecting the presence of the turns of the reserve and varying the position of the first turn when a variation occurs in the angle of incidence between said optical sensor and the drum due to the variation in the inclination of said intermediate support.

6. A device for monitoring a yarn reserve in weft feeders for textile looms, wherein the device includes an intermediate support which is adapted to be oscillatably supported by a fixed frame of the feeder said device being controlled by adjustment means for varying the position of the support with respect to a drum of the feeder.

* * * * *